United States Patent [19]

Garrigues et al.

[11] Patent Number: 4,995,305

[45] Date of Patent: Feb. 26, 1991

[54] ACTUATOR EMPLOYING A FLUID UNDER PRESSURE FOR THE DRIVING IN ROTATION OF A ROTARY SHAFT

[75] Inventors: Jean-Claude Garrigues, Cadaujac; Rene Laulhe, Villenave D'Ornon; Pierre Rieuvernet, Merignac, all of France

[73] Assignee: Applications Mecaniques et Robinetterie Industrielle, Bagnolet Cedex, France

[21] Appl. No.: 321,195

[22] Filed: Mar. 9, 1989

[30] Foreign Application Priority Data

Mar. 9, 1988 [EP] European Pat. Off. ..... 88400548

[51] Int. Cl.[5] ..... F01B 9/00

[52] U.S. Cl. ..... 92/138; 92/130 D; 92/132; 92/120; 92/140; 92/165 R

[58] Field of Search ..... 92/31, 32, 33, 60, 80, 92/84, 109, 110, 116, 130 R, 130 C, 130 D, 131, 132, 138, 139, 140, 163, 165 R, 120

[56] References Cited

U.S. PATENT DOCUMENTS 4,796,514 1/1989 Richter ..... 92/33

FOREIGN PATENT DOCUMENTS

| | | | |
|---|---|---|---|
| 2344932 | 4/1974 | Fed. Rep. of Germany | 92/138 |
| 2141161 | 1/1980 | Fed. Rep. of Germany | 92/138 |
| 535262 | 4/1922 | France | 92/138 |
| 0024605 | 2/1983 | Japan | 92/138 |
| 0131412 | 8/1983 | Japan | 92/138 |
| 255245 | 7/1926 | United Kingdom | 92/138 |
| 838647 | 6/1960 | United Kingdom | 92/131 |
| 2069051 | 8/1981 | United Kingdom | 92/130 C |

*Primary Examiner*—Edward K. Look
*Assistant Examiner*—Thomas Denion
*Attorney, Agent, or Firm*—M. H. Gay

[57] ABSTRACT

An actuator having a tubular body with a cylindrical bore therein within which a piston reciprocates, an output shaft extending into said bore and a linkage for converting the linear movement of the piston into the rotary motion of said shaft. The linkage is contained entirely within said bore. In one form the piston is spring loaded and a spring follower also provides a piston for compressing the spring to permit the force exerted on the piston to be transmitted to the output shaft substantially in its entirety.

5 Claims, 4 Drawing Sheets

ACTUATOR EMPLOYING A FLUID UNDER PRESSURE FOR THE DRIVING IN ROTATION OF A ROTARY SHAFT

This invention relates to an actuator using a fluid under pressure for the driving in rotation of a rotary shaft.

It is used in particular, but not exclusively, for controlling valves having one-quarter turn action, such as butterfly valves.

Hydraulic or pneumatic actuators of the type employing a piston and rod moving perpendicular to the drive shaft of the valve are known. Various arrangements have been employed to convert the alternating linear rod movement to alternating rotational movement.

French Patent No. 1,460,561 discloses a piston-cylinder unit having a connecting rod articulated on the piston and articulated to a lever arm which is mounted in fixed position on a drive shaft, said rod and arm extending in planes at right angles to the axis of said shaft. Ordinarily this conversion device is enclosed in a casing on which the body of the piston-cylinder unit is attached in such a manner that the connecting rod passes into the casing.

It has been found that actuators of the type shown in this patent (hereinafter referred to as "linkage type") have relatively complicated structures employing a relatively large number of parts which must be machined, such as casing, body of the piston-cylinder unit, devices for the assembling of the piston-cylinder unit on the casing, device for the assembling of the casing on the body of the valve, etc. These actuators are accordingly heavy, bulky and of relatively high cost to manufacture.

Linkage type actuators have the advantage of high torque and slow speed as the valve member approaches and leaves its closed position.

An object of this invention is to simplify the structure while retaining the main advantages of the linkage type actuator so as to obtain a unit which is compact, light and economical.

Another object is to provide a linkage type actuator employing a constant diameter cylinder in which a piston and rod reciprocate, with a rotary output shaft journaled in the cylinder normal to the central axis of the cylinder and connected to the piston rod with a suitable linear to rotational movement connection.

Another object is to provide a linkage type actuator having a constant diameter cylinder in which a rotary output shaft is journaled in the cylinder normal to and substantially intersecting the central axis of the cylinder.

Another object is to provide an actuator as in the preceding object in which the link between the piston and a lever carried by the output shaft is articulated to the piston at a point radially offset from the central axis of the cylinder.

Another object is to provide a linkage type actuator having a piston carrying an articulated linkage in which a piston guide is provided on the side of the articulated linkage opposite the piston head.

Another object is to provide an actuator having a cylinder with a main piston reciprocal in one direction by a spring and in the other direction by fluid pressure in which a second pressure responsive piston engages and compresses the spring.

Another object is to provide an actuator having a cylinder with a main piston reciprocal in one direction by a spring and in the other direction by fluid pressure on the piston in which the spring follower for compressing the spring provides a second pressure responsive piston.

Other objects features and advantages of this invention will be apparent from the drawings, the specification and the claims.

This invention provides an actuator having a piston-cylinder unit comprising a body provided with a cylindrical bore within which a piston reciprocates. This piston defines two chambers within the bore, at least one of which constitutes a working chamber into which fluid under pressure is admitted. The invention includes a device for conversion of the linear movement of the piston into rotation of an output shaft which is housed entirely within said cylinder bore and directly actuated by the piston. The shaft is journaled in the body and extends substantially radially to the central axis of the cylinder bore. In one preferred form the output shaft is urged in one direction by a spring and a spring follower is also a piston assisting in moving the output shaft.

This invention is further characterized by being of the linkage type in which a link is articulated to the piston and on an arm carried by the output shaft, with the link and arm extending in planes at right angles to the axis of the shaft.

The output shaft may form an integral part of the actuator and provide means for coupling with the actuating shaft of the driven device. In this case the output shaft can advantageously be journaled in opposite sides of the body. Alternatively the output shaft may consist of a section of the actuating shaft of the driven device. In this case the section of the actuating shaft extending into the cylindrical body may be journaled in one or opposite sides of the body.

In accordance with this invention said cylinder-piston unit may be of the double acting type. In this case the piston defines two opposite working chambers into which pressure fluid is admitted. One of the chambers houses the conversion device. In this case sealing means must be provided on the output shaft at its journals.

In the drawings wherein illustrative embodiments of the invention are shown and in which like numerals indicate like parts:

Figure 1:
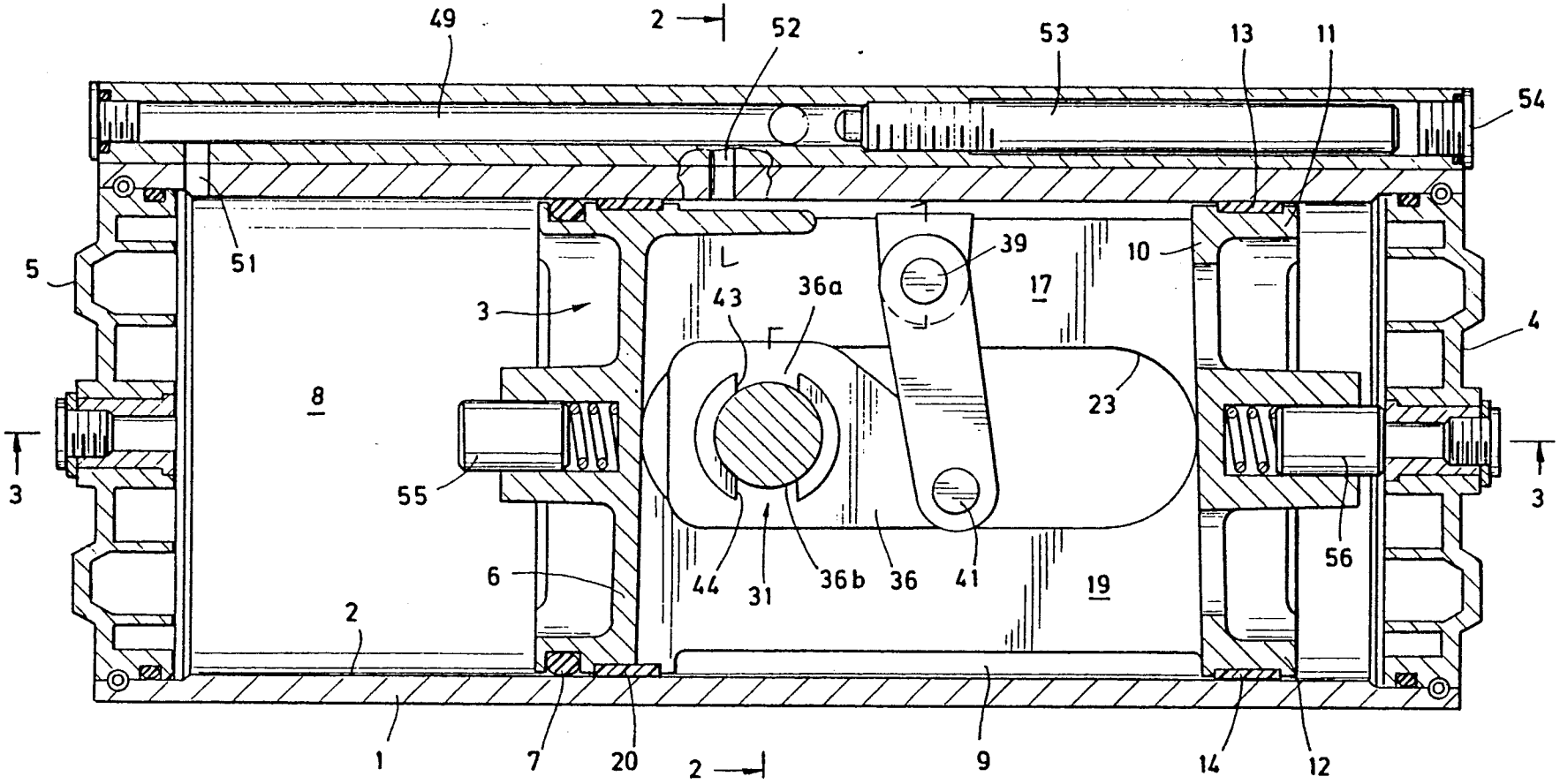
FIG. 1 is a view in cross section with some parts shown in elevation, in a plane perpendicular to the output shaft, of an actuator according to a preferred embodiment of the invention.
Figure 2:
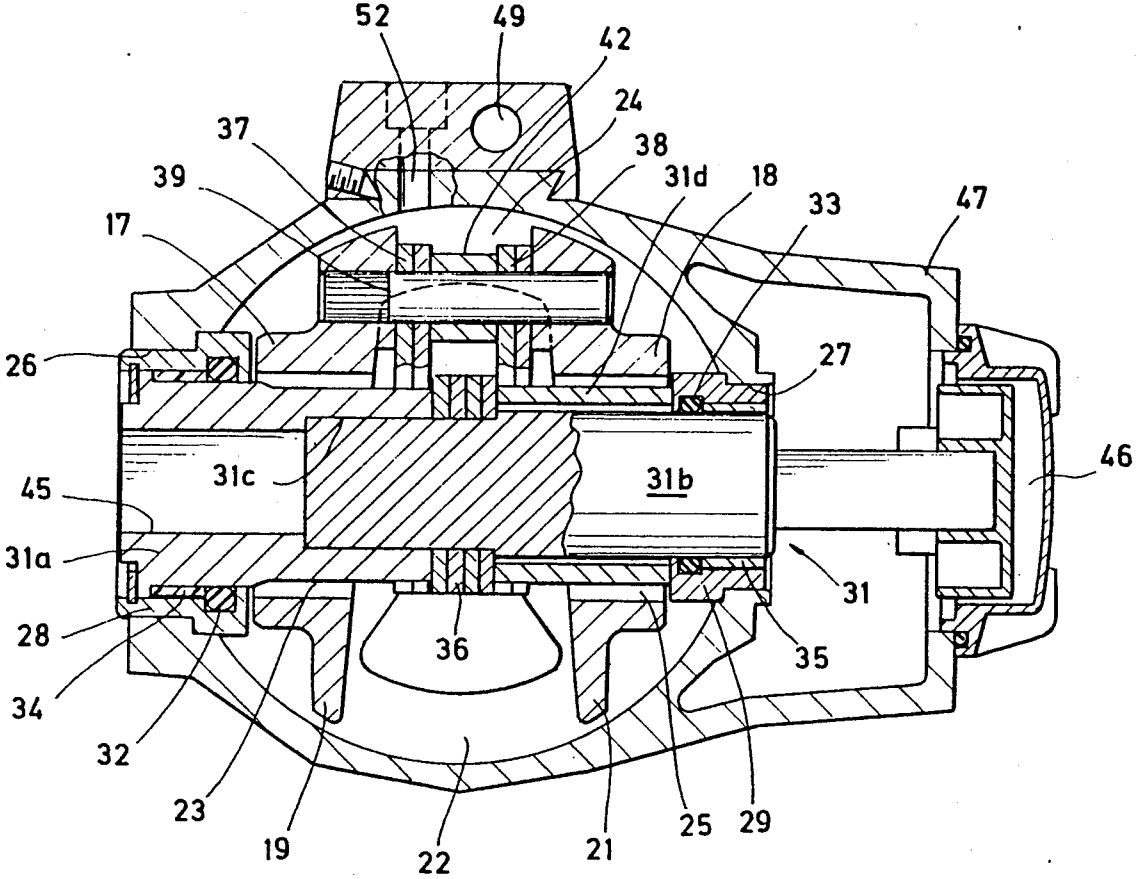
FIG. 2 is a cross section along the lines 2—2 of FIG. 1.
Figure 3:
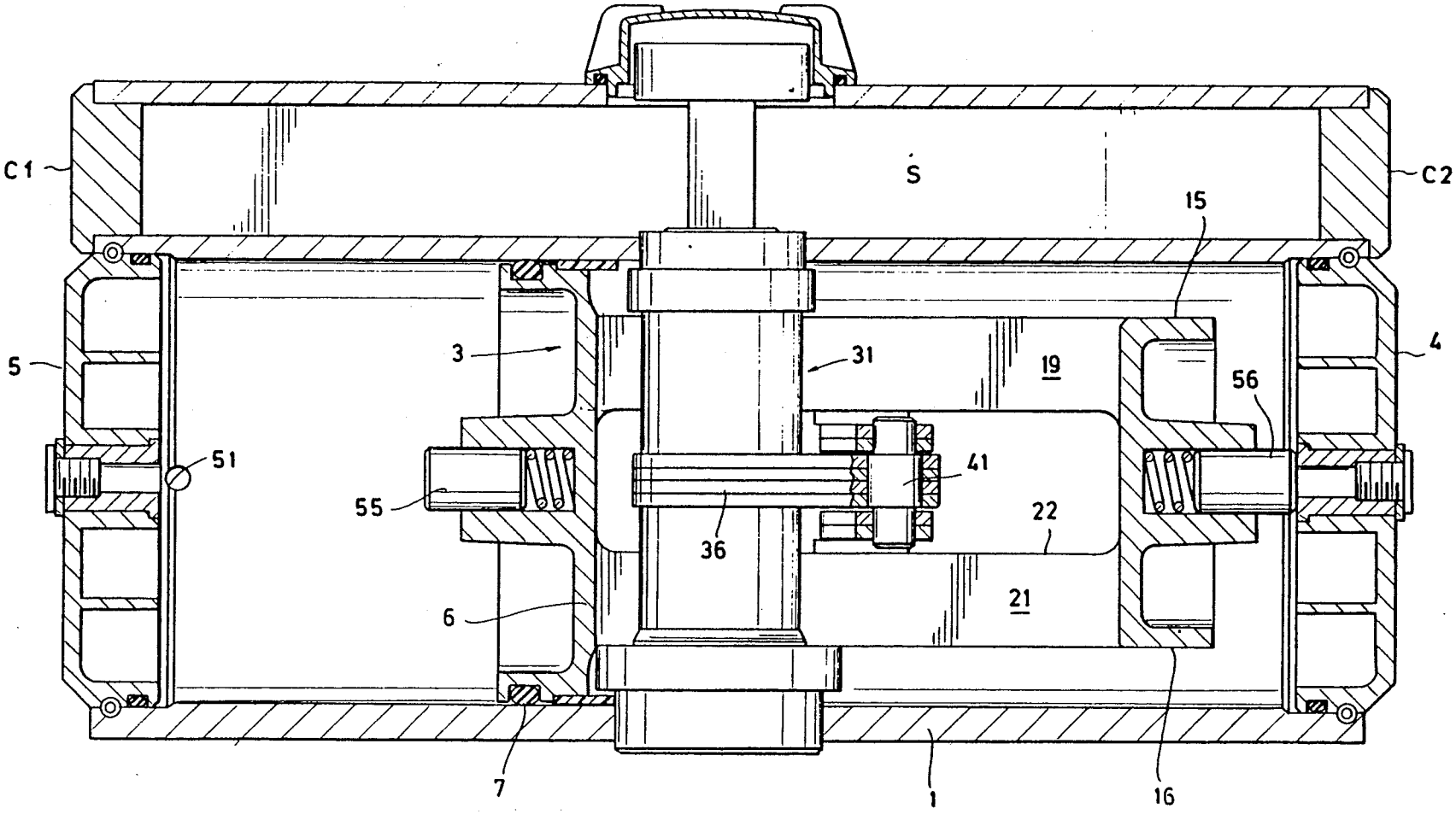
FIG. 3 is a view in cross section with some parts shown in elevation, in a plane passing through the axis of the output shaft.

As shown in FIGS. 1 to 3, the actuator comprises a tubular body 1 with a constant diameter cylindrical bore 2 within which there slides a piston indicated generally at 3. This tubular body 1 is closed at each end by corresponding heads 4 and 5.

The piston 3 has, at one of its ends a solid circular head 6 of a diameter substantially equal to that of the bore 2. Provided on the periphery of the head 6 is a seal 7, preferably an O-ring, which assures a sliding seal with the cylindrical surface of the bore 2. An annular antifriction support 20 for the piston head, preferably of Teflon is carried on the exterior of the piston head adjacent the seal 7. The piston head 6 defines two chambers 8 and 9 of variable volume which are hermetically separated from each other.

The piston is maintained coaxial to the bore 2 by means of a guide member 10 consisting of a flat part which extends radially in the bore and has two opposite circular rims 11 and 12 substantially of the diameter of the bore 2, provided with antifriction support 13 and 14, such as Teflon (FIG. 1) and two opposite rims 15 and 16 preferably linear, which extend between the opposite ends of the circular rims 11 and 12 (FIG. 3). This guide member 10 is connected to the piston head 6 by four axial longitudinal spacer members 17, 18, 19 and 21 of angular shape which are arranged symmetrically with respect to the central longitudinal axis of symmetry of the bore 2 with their concavities directed away from said axis. These lengthwise spacer, members 17, 18, 19 and 21 define with each other an axially elongated free volume of cruciform cross section, resulting in four slots 22, 23, 24, and 25 which extend axially over a distance greater than the stroke of piston 3. Preferably the piston head, guide and four spacer members are fabricated from a single piece of stock. Preferably the slots 23 and 25 are designed to receive an output shaft and their length is preferably equal to the stroke of the piston plus the diameter of the output shaft.

To provide for mounting of an output shaft the body 1 of the cylinder-piston unit is provided with two diametrically opposite substantially radial holes 26 and 27 which open into the bore 2 with their centerlines extending through slots 23 and 25 in the piston 3. These holes 26 and 27 are equipped with bearings 28 and 29 in which there are rotatably mounted the ends of the output shaft indicated generally at 31 which passes diametrically across the bore 2 and extend through slots 23 and 25 in the piston 3. The shaft is sealed in the bearings by seals such a O-rings 32 and 33 and supported on antifriction means such as Teflon sleeves 34 and 35.

The output shaft includes a wrench sleeve 31*a* for nonrotatably receiving a shaft of a driven device such as the shaft of a butterfly valve. The internal end of the sleeve is slotted on opposite sides at 43 and 44. A close fitting pin 31*b* in nonrotatably positioned in bore 31*c* in sleeve 31*a* and a spacer sleeve 31*d* is positioned on the pin 31*b*.

Conversion of the linear movement of piston 3 to rotary movement of output shaft 31 is accomplished with a linkage type conversion system. A lever or moment arm 36 is nonrotatably secured to the output shaft and is positioned in slots 22 and 24. The arm 36 slides on pin 31*b* and is provided with inward projections 36*a* and 36*b* for engaging in slots 43 and 44. The arm is held in position on shaft 31*b* by sleeve 31*d*. A linkage or connecting rod is provided in slot 24 by two links 37 and 38 articulated to the piston by pin 39 and to the arm 36 by pin 41. The two links are arranged on opposite sides of arm 36 and are spaced on pin 39 by the sleeve 42. As shown the pin 39 may be positioned in the two lengthwise spacer members 17 and 18 of piston 3. The length of the spacer sleeve 42 is such as to maintain the ends of the links 37 and 38 against the lengthwise members 17 and 18 assuring permanent guidance of the connecting rod during its pivoting movement. This arrangement is particularly advantageous as compared with the conventional solutions in which the guidance of small ends of the links is customarily obtained by grooves machined in the casing, an arrangement which is furthermore incompatible with the solution proposed by this invention.

The positioning of the output shaft to extend through slots in the piston 3 and the extension of the links 37 and 38 through slots in the piston position the entire conversion assembly and output shaft within the cylinder 2 and reduce the usual number and complexity of housing parts.

In the embodiment shown, the coupling of the output shaft 31 and of the drive shaft of the driven device, such as a butterfly valve, is obtained by engagement of a square provided on the head of the drive shaft into an axial recess 45 of complementary shape in one end of the output shaft 31.

Furthermore, the output shaft 31, at its other end, drives a device 46 for the signaling of the state of the actuator, housed within a housing 47 integral with the body of the cylinder-piston unit.

For this purpose, the body has a prismatic shape defining two chambers which extend axially alongside of each other, namely:

a cylindrical chamber defined by the bore 2 which is reserved for the supplying of power, and a chamber S of substantially trapezoidal cross section closed at its two ends by two heads C1 and C2 respectively, which chamber can serve to receive an integrated signaling device (for instance, an electric signaling device).

This structure has the advantage of permitting production of the body by extrusion or a similar process.

The operation of the above described actuator can be of single-acting or double-acting type.

Thus, in the case of operation of the double-acting type the chamber 8 can constitute a working chamber of the actuator. The feeding of this chamber 8 with fluid under pressure, for instance with compressed air through axial conduit 49 on the body of the cylinder-piston unit through inlet orifice 51 provides working pressure.

Pressure fluid in chamber 9 which contains the conversion device 36 and 37 is relieved through discharge conduit 52. In a double acting system as shown in FIG. 1 the pressure system is reversed for reverse action of piston 3 and pressure is introduced through orifice 52 and released through orifice 51. A mechanical actuator 53 is stored in one end of the conduit 49 and accessible through plug 54.

In all cases the stroke of the piston can be regulated by means of two adjustable stops 55 and 56 provided on the piston head 6 and on the guide element 10 respectively. These two stops come against the head 5 or the head 4 at the end of the stroke.

Figure 4:
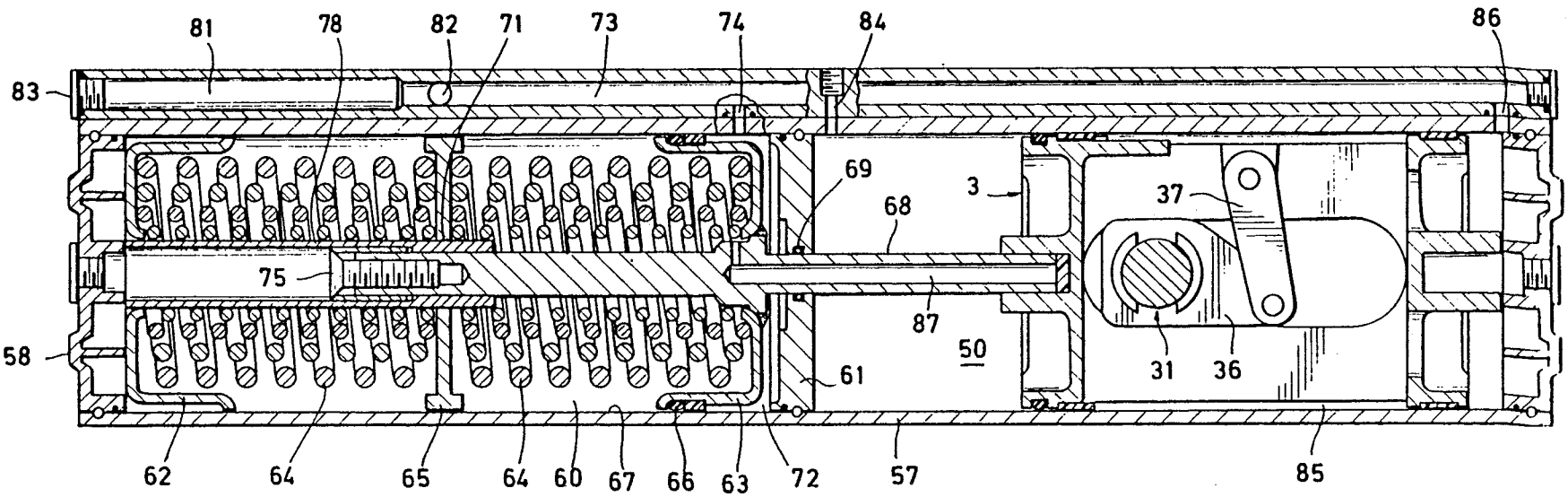
FIG. 4 is a cross sectional view similar to FIG. 1, with some parts shown in elevation of a single acting construction with return provided by a spring and the spring follower also providing a piston assisting the main piston.

FIG. 4 shows an embodiment of such an actuator using springs in cartridges. The cylinder-piston unit of the actuator has a body 57 of a structure similar to that previously described, but much more elongated. The space defined by the bore of this body 57 and the two closure heads 58 and 59 is then divided into two chambers by a central partition 61. A first chamber 50 located to the right of partition 61 contains all of the elements of the actuator shown in FIG. 1, and, in particular, the piston 3, the output shaft 31 and the conversion device 36 and 37. A second chamber 60 located to the left of partition 61 houses a spring cartridge.

This spring cartridge comprises two supporting shells which provide a stop 62 and a spring follower 63. A plurality of axial springs 64 are supported in their central region by an axially sliding holding disk 65. The stop 62 abuts the cover 58. The spring follower 63 is provided with a sliding seal 66 for sealing with the housing bore 67. This spring follower 63 is attached to a coaxial rod 68 which slides in a seal 69 in a passage orifice provided in the center of the partition 61. The rod abuts the piston 3. The spring follower may be secured to the rod 68 in any desired manner such as by welding. This rod 68 extends into the spring chamber and passes through a central orifice 71 in disc 65 and slides in a tube 78 forming a support for the holding disc 65.

The space between the partition 61 and the spring follower 63 forms a working chamber 72 which communicates with the pressure fluid conduit 73 by an orifice 74. Thus, the spring follower provides a piston for compressing the spring 70 to store a return force for the actuator. This permits substantially the entire force exerted on the piston 3 to be utilized for rotating the output shaft.

The fluid conduit 73 may have a plug 79 in one end and receive a mechanical operator 81 in the other. A ball 82 having a resilient surface may close the other end. The plug 83 may also include a seal but the ball 82 is the primary seal. The spring chamber 60 is connected to the chamber 50 of the cylinder-piston unit by a decompression channel 87 in the rod 74. This chamber is vented by port 84.

When a fluid under pressure is admitted into the conduit 73 the pressure produced in the chamber 85 of the cylinder-piston unit through port 86 and in the chamber 72 will cause displacement towards the left of the piston and the spring follower-piston 63 will compress the springs 64.

This displacement will continue until the adjustable stop 75 provided at the end of the rod 68 abuts the head 58. As noted above, during this displacement, the energy of the fluid under pressure within the working chamber 72 will serve essentially to ensure the compressing of the springs 64 so as to retain in full the useful torque which the actuator would develop in the absence of the spring return means. Also, upon venting of pressure from the two pistons the energy stored in the springs will return the piston 3 to its initial position.

It will be seen from the above that placing the output shaft and its linkage with the piston within the cylinder-piston unit results in greater compactness than the previous solutions and permits simpler machining of the cylinder-piston body as compared with the multiple machinings which were previously effected. The guidance of the connecting rod small ends, which was effected up to now in grooves machined into the casing, is now effected via the piston itself and thus employs the cylinder as a bearing surface, which simplifies both construction and machining.

The previous description is illustrative of embodiments of the present invention. Changes and modifications will be readily apparent to those skilled in the art and may be made without departing from the scope of the invention which is defined in the claims.

What is claimed is:

1. Actuator using a pressurized fluid, for driving a rotary shaft in rotation comprising:

a one piece tubular body having a cylindrical bore;

a piston slidable within said bore and comprising;

a circular member having a sealing ring on the periphery of the member providing a sliding seal with the cylindrical surface of the bore, said member defining, inside said bore, two chambers at least one of which forms a work chamber into which opens a conduit for the intake of pressurized fluid, a guide element sliding in the bore, without providing sealed separation of the volume defined by said bore, said guide element being connected to the closure member by four longitudinal members disposed symmetrically with respect to the longitudinal axis of symmetry of the bore so as to define at least one free volume of cruciform section having a first and second perpendicular branches;

a control shaft extending inside said bore and passing through at least one orifice provided in said body and through said first branch; and means for converting said rectilinear movement of the piston into a rotary movement of said control shaft comprising;

at least one link having one end articulated to the piston and the other end to a lever arm fixedly mounted on said control shaft, said link and said arm extending in planes orthogonal to the axis of said control shaft, said lever arm and said link moving in said second branch.

2. The actuator of claim 1 wherein said link is mounted, by one of its ends, for rotation about a transverse pin supported by two oppositely disposed longitudinal members.

3. The actuator of claim 1 or 2 wherein said piston comprises means for guiding said links.

4. The actuator of claim 1 wherein said bore is divided into two compartments by a transverse dividing wall, said first compartment containing the piston, the control shaft and the conversion means;

spring means in the other compartment for urging the piston in one direction, and the spring means includes a spring follower which provides a second piston in said cylindrical bore for comprising the spring of said spring means.

5. The actuator of claim 4 wherein said piston and second piston are exposed to the same fluid pressure for actuation.

* * * * *

UNITED STATES PATENT AND TRADEMARK OFFICE

CERTIFICATE OF CORRECTION

PATENT NO. :4,995,305

DATED :Feb. 26,1991

INVENTOR(S) :Garrigues, Laulhe & Rieuvernet

It is certified that error appears in the above—identified patent and that said Letters Patent is hereby corrected as shown below:

Col. 6, Line 53, change "comprising" to-compressing-

Signed and Sealed this

Eighteenth Day of August, 1992

*Attest:*

DOUGLAS B. COMER

*Attesting Officer*

*Acting Commissioner of Patents and Trademarks*